United States Patent [19]

Bjerke et al.

[11] Patent Number: 4,963,201

[45] Date of Patent: Oct. 16, 1990

[54] PRIMER COMPOSITION

[75] Inventors: Robert K. Bjerke; James P. Ward, both of Lewiston, Id.; Delbert O. Ells, Clarkston, Wash.; Kenneth P. Kees, Lewiston, Id.

[73] Assignee: Blount, Inc., Montgomery, Ala.

[21] Appl. No.: 463,234

[22] Filed: Jan. 10, 1990

[51] Int. Cl.[5] ..... C06B 45/00

[52] U.S. Cl. ..... 149/2; 149/21; 149/62; 149/88; 149/109.6

[58] Field of Search ..... 149/2, 21, 62, 88, 109.6

[56] References Cited

U.S. PATENT DOCUMENTS

| | | | |
|---|---|---|---|
| 3,423,259 | 1/1969 | Staba | 149/24 |
| 4,363,679 | 12/1982 | Hagel et al. | 149/37 |
| 4,566,921 | 1/1986 | Duguet | 149/22 |
| 4,581,082 | 4/1986 | Hagil et al. | 149/105 |
| 4,608,102 | 8/1986 | Krampen et al. | 149/92 |

OTHER PUBLICATIONS

TM 9-1300-214, "Military Explosives", Chapter 10, 10-1.

PATR 2700, "Encyclopedia of Explosives", vols. 8, N 38-39 and 9, S 221-222.

"The Chemistry of Powder and Explosives", T. L. Davis, John Wiley & Sons, Inc. (1943), pp. 60-85.

*Primary Examiner*—Stephen J. Lechert, Jr.

*Attorney, Agent, or Firm*—Klarquist, Sparkman, Campbell, Leigh & Whinston

[57] ABSTRACT

Primer composition comprising diazodinitrophenol or potassium dinitrobenzofuroxane, tetracene, nitrate ester fuel and strontium nitrate. It is prepared by hydrating anhydrous strontium nitrate by dissolving in warm water and thereafter cooling solution to obtain crystals of the tetrahydrate. These crystals are mixed with other components to form the primer composition.

11 Claims, No Drawings

PRIMER COMPOSITION

BACKGROUND OF THE INVENTION

This invention relates to primer compositions useful in small arms ammunition and the like.

The priming composition in small arms primers is a discrete chemical system, as well as an integral part of the unit generally known as the primer. The small arms primer consists of a cup, an anvil and the priming composition. The cup serves as a container for both the composition and the anvil and generally possesses standard dimensions for fit with the case pocket of various types of small arms cases.

Typically, in manufacture of a primer, the cup is charged with wet priming composition which is thereafter dried to give a resultant dry composition weight of only a few milligrams. A paper disc may be placed on the composition and the anvil pressed into the open end of the cup. Primers fitted with anvils are known in the ammunition industry as Boxer primers. A second type of primer known as the Berdan primer consists of only the cup, the composition and a seal over the surface of the composition.

Boxer primers must be used with ammunition wherein the pocket is a cylindrical well in the cartridge case head. A flash hole is located between the case pocket and the main portion of the case where the propellant is loaded. Berdan primers are for exclusive use with ammunition wherein the pocket is a cylindrical well with a centrally located anvil integral to the case. A pair of flash holes are located on each side of the anvil. The ignition process in either the Boxer or Berdan priming system is similar except that the former results in one gas jet and the latter results in two.

Ignition of a primer is initiated by impact of a weapon firing pin against the central portion of the cup. This mechanical energy deforms the cup, compressing the priming composition against the anvil. Resulting areas of heat in the rapidly compressed composition cause it to ignite almost instantaneously and burn at a very high rate. The ejecta of the combustion reaction, consisting of hot particles and gases, are typically directed to the propellant by means of the flash holes in the base of the case pocket.

The priming composition used for small arms primers must possess sensitivity to impact or mechanical shock. This sensitivity is generally measured by dropping a weight at various distances onto a firing pin situated over the test primer. Typically, groups of 50 primers are tested at different drop heights until data for the group is obtained to predict no-fire, 50% fire, and all-fire levels for the primer. SAAMI (Sporting Arms and Ammunition Manufacturers Institute) specifications for small pistol primer sensitivity are: no function below an one inch fall of the test weight and all-fire at an eleven inch or greater fall, using a 1.94 oz. ball weight. A number of factors are involved in producing such sensitivity levels, but clearly, the priming composition is the most critical. Generally, priming compositions contain a primary explosive—a chemical compound which is impact sensitive. The primary explosive in almost all cases must be modified because it is too powerful or its velocity of detonation is too high. The modification to the effects of the primary explosive is accomplished by the addition of other chemical ingredients which may function as fuels, oxidizers or other agents in the chemical system.

Historically, a number of primer compositions have found use in small arms primers. Over a period of time, most of these have been replaced. For example, mercurous compositions possessed undesirable shelf-life, and along with various chlorates, were found to cause gun barrel erosion. But, since they met the difficult sensitivity and ignition requirements, they were used until improvements were found.

The primary explosive lead styphnate replaced the earlier compounds during WWII, and was the advent of the non-corrosive priming mixtures. These were all based on lead styphnate with various combinations of tetracene, aluminum, antimony sulfide, calcium silicate, lead peroxide, boron, pyrophoric metals and barium nitrate. Variations in ingredients and their relative amounts resulted in chemical systems which possessed sensitivity and propellant ignition properties tailored to specific requirements. These priming compositions have been so reliable that they are, for the most part, still in current use in small arms primers.

Growing concern over environmental hazards and potential effects on individual health, particularly in indoor shooting ranges, has led to investigations and studies of primer exhaust. The occurrence of toxic oxides of lead, barium and antimony, among other exhaust products, from lead styphnate primers has prompted the search for alternate priming compositions by a number of researchers. U.S. Pat. No. 4,608,102 to Krampen et al., owned by the assignee of the present application, for example, relates to a primer composition wherein manganese dioxide and zinc peroxide or strontium peroxide are used as oxidizers in place of barium nitrate. U.S. Pat. No. 4,363,679 relates to a primer composition in which zinc peroxide is the primary oxidizer. These compositions eliminate environmentally hazardous combustion products, but they possess a low flame temperature which, on occasion, creates performance problems.

SUMMARY OF THE INVENTION

A principal object of the present invention is to provide a new and improved primer composition for use in small arms primers which will not only provide minimal environmental hazard, but which possesses the sensitivity and ignition characteristics possessed of current small arms primers.

A further object is to provide a new and improved primer composition which can be used in current priming and ammunition systems without major modification to primer or case.

Still another object is to provide a new and improved composition which may be manufactured and transferred to the primer cup without modification to equipment or procedure currently in use.

A specific object of the invention is to provide a primer composition having minimal environmental hazard, but possessing superior performance characteristics.

Another object is to provide a method for making small arms primer composition containing strontium nitrate.

DETAILED DESCRIPTION

The primer composition of the present invention comprises a percussion sensitive explosive combined with a nitrate ester fuel, such as a small arms propellant, a secondary explosive such as tetracene, and strontium nitrate. Certain modifiers may be used as explained below.

The preferred percussion sensitive explosive is diazodinitrophenol (DDNP) which may be present in a range of from 20% to 50% by weight. (Composition percentages herein are based on the dry Weight of the components.) However, DDNP greatly affects the energy output of the primer composition and the percentage used must be reflected in the charge weight. Potassium dinitrobenzofuroxane would also be a suitable primary explosive.

Tetracene is utilized as sensitizer or secondary explosive and may be present in a range of from 4% to 8% by weight.

Strontium nitrate is present as an oxidizer. While its percentage in the composition may be varied from 40% to 52%, it is preferably present in stoichiometric balance with the fuels and explosives present.

A preferred propellant is a spherical propellant offered by Olin Corp. under the identification #WC669. This propellant consists of spheres having an average diameter of about 0 015 inch and consisting of 10% nitroglycerine and 90% nitrocellulose. The spheres have a deterrent coating, such as graphite, on their surface of about 2.75% by weight of the sphere to slow the burning rate. The propellant ratio in the composition may vary from 15% to 30% by weight depending upon the amounts of other ingredients.

Propellant fines consisting of 60% nitrocellulose and 40% nitroglycerin also are satisfactory and other commercially available propellants could be used in small particle sizes, i.e., from 0.011to 0.018inch, as could such materials as DNT, picric acid or nitroquanidine.

Fuels such as the pyrophoric metals titanium, zirconium and hafnium (and their carbides and nitrides) can also be used in small amounts (up to 8%) to increase flame temperature, but their affect is minimal. Powdered aluminum also increases flame temperature, which may be desirable in certain applications, but its presence reduces impact sensitivity, and it is thus not preferred in primers for pistol ammunition.

We have found that the chemical compound selected as the oxidizer proved to be the most critical of the ingredients to be included in the chemical system of a primer composition. Previous research by us and other investigators has centered on the insoluble or amphoteric dioxides and peroxides such as manganese dioxide and/or zinc peroxide. While these oxidizers met many criteria, they gave performance problems in propellant ignition which was traced to relatively low flame temperatures of the order of 2200 to 2500 degrees Kelvin. The lead styphnate type priming compositions which result in toxic exhaust compounds typically exhibit flame temperatures 2900 to 3400 degrees K.

We have found that strontium nitrate in the specified ratios with diazodinitrophenol and selected fuels results in a primer composition with a flame temperature of about 3050 degrees K.

Strontium nitrate possesses properties which, if it is not properly handled, can contribute to undesirable moisture conditions in the primer mixture. Under certain storage conditions, it may draw moisture from the other ingredients creating potential hazardous conditions. In other instances, it may release moisture rendering the priming mixture too wet for processing. We have found that pre-processing (partial hydration) the strontium nitrate reduces the effect of moisture migration in the primer mixture at least to the extent that stability of two to three days is achieved.

Strontium nitrate occurs as the anhydrous $Sr(NO_3)_2$ or the tetrahydrate $Sr(NO_3)_2.4H_2O$. Depending on a number of factors, these exist in a reversible equilibrium. In addition, both forms are very soluble in water, the anhydrous absorbing heat as it dissolves, the tetrahydrate giving off heat as it dissolves.

We have noted two extreme conditions which subsequently can occur. If the anhydrous form is used, the priming mixture is self-drying, e.g., the strontium nitrate tends to absorb the free moisture as it goes to the tetrahydrate. This condition worsens at low temperatures typically found in priming mix storage areas. If the tetrahydrate is used, as it dissolves in the free water available in the mixture, it loses its water of hydration. In this case, bound water becomes free water and the mixture is self-wetting.

We have found that commercially available anhydrous strontium nitrate (Spec. MIL-S-20322B) which has been pre-processed to a total moisture of 10 to 13% can obviate these mixture conditions to the extent that equilibrium reactions in the priming mixture are reduced and delayed. The 10 to 13% material might be considered as either $Sr(NO_3)_2.1.5H_2O$, or perhaps more properly $3Sr(NO_3)_2.4HO_2O/5Sr(NO_3)_2$. Use of the ? 0 to 13% pre-hydrate strontium nitrate results in primer mixture stability for two to three days when stored at 100% relative humidity and a temperature of 70 degrees F. After several days at these conditions, there is a tendency for the mixture to "dry", so it should be processed into primers as soon as possible after mixing.

We find that the best crystal size and shape of 10 to 13% hydrated strontium nitrate is obtained by recrystallization of hydrated strontium nitrate from solution and further treating the recrystallized material as explained below. In accordance with this method, anhydrous strontium nitrate is dissolved in warm water, e.g., 80 degrees F., to form a saturated solution. The solution is then chilled to 36 to 38 degrees F. Strontium nitrate tetrahydrate precipitates with a yield of approximately 400 g/liter. This is filtered and may be stored in a sealed container below 75 degrees F.

Strontium nitrate tetrahydrate thus prepared is reduced to the 10 to 13% moisture level by agitating the crystallized material in moving warm air, e.g., 75 degrees F. This may be done by calculating the weight of water which must be driven off and treating the batch until it is reduced to the weight at which 10 to 13% water will be present.

It is also possible to prepare the 10 to 13% material by adding anhydrous strontium nitrate and the necessary amount of water, agitating and chilling to 40 degrees F. However, this results in a congealed mass which must be ground to the proper crystal granulation. We have found that, in this case, proper crystalline shape and particle size is difficult to achieve and prefer the method described above.

It is important that once the material as been thus prepared, it be sealed from the atmosphere and maintained at 70 to 75 degrees F. It is also imperative that the priming mixture, after it is prepared, be held in the same conditions until sealed in the primer container.

In preparing a primer, the primary and secondary explosive are mixed wet. The propellant, which is dry, is then blended in and thereafter the strontium nitrate crystals are blended in. The completed wet priming mixture is then pressed into a perforated plate to form pellets of desired sizes for loading into primer cups. After charging the cups, a foil paper is tamped onto the wet charge, a layer of sealing lacquer placed over the foil, and the primers dried in a dry house.

The preferred composition of Table I met all other criteria and possessed excellent ignition characteristics:

TABLE I

| Preferred Composition | |
|---|---|
| Diazodinitrophenol | 24% |
| Strontium Nitrate | 48% |
| .015 ball propellant | 22% |
| Tetracene | 6% |

The exhaust from this primer composition consists of 76.8% by weight of gases and 23.2% by weight of hot particles as shown in Table II. Typical sensitivity data for this formulation are given in Table III and typical ballistics results are given in Table IV.

TABLE II

| Ratio of Ignition Products | |
|---|---|
| Carbon monoxide | 8.0% |
| Carbon dioxide | 39.9% |
| Steam | 8.4% |
| Nitrogen | 20.4% |
| Strontium oxide | 23.2% |

This exhaust is environmentally acceptable and free of any toxic compounds. It is unusual in that the ratio of gases is considerably greater than from the older lead styphnate primer compositions. The high rate of gas production, along with the high detonation velocity of diazodinitrophenol results in a priming composition of higher brisance: in general terms the primer would be quicker and more powerful. This undesirable "robustness" is addressed by corresponding adjustment to the primer charge.

It has been found that approximately one-half as much of this primer composition need be used to deliver the same ignition pulse as former lead styphnate compositions. The primer composition of the invention produces 487 cc gas/gram of primer compared to approximately 230 cc gas/gram of the conventional lead styphnate priming compositions. As this information suggests, for example, 11 mg. of the composition produces an ignition pulse equivalent to 22 mg. of the lead styphnate type priming compositions, although this may vary slightly due to various additives in the range of styphnate formulations.

TABLE III

| Typical Sensitivity Data for Pistol Primers | | |
|---|---|---|
| Test Values* | Boxer Primers | Berdan Primers |
| H-bar | 4.4 inches | 3.7 inches |
| Sigma | 0.9 inches | 0.7 inches |
| H-bar + 5Sigma | 8.9 inches | 7.2 inches |
| H-bar − 2Sigma | 2.6 inches | 2.3 inches |

*Sensitivity to impact is measured in terms of how far a 1.94 oz. weight must drop to achieve primer function. H-bar is the height at which 50% of the test primers fire. H-bar + 5Sigma is the predicted all-fire height and H-bar − 2Sigma is the predicted no-fire height.

TABLE IV

| Typical Ballistics Test Results | | |
|---|---|---|
| | 9 mm Pistol Round | .38 Cal Pistol Round |
| Bullet type | 124 grain TMJ | 125 Grain HP |
| Propellant/charge | Accurate #7/8.5 gr | BE#84/7.3 grain |
| Chamber Pressure | 30,000 psi | 17,000 psi |

TABLE IV-continued

| Typical Ballistics Test Results | | |
|---|---|---|
| | 9 mm Pistol Round | .38 Cal Pistol Round |
| Pressure Range | 3,400 psi | 1,800 psi |
| Muzzle Velocity | 1100 ft/sec | 1150 ft/sec |
| Velocity Range | 50 ft/sec | 40 ft/sec |

As will be apparent to those skilled in the art, the test results shown above indicate that the primer composition is satisfactory for its intended purpose and is an environmentally acceptable formulation which may be directly substituted for previous compositions while providing very similar characteristics in terms of the various criteria utilized in the art.

The invention being thus described, it will be obvious that the same may be varied in several ways. Such variations are not to be regarded as a departure from the spirit and scope of the invention, and all such variations are intended to be included herein.

We claim:

1. A primer composition comprising:

a percussion-sensitive explosive selected from the class consisting of diazodinitrophenol and potassium dinitrobenzofuroxane;

a secondary explosive comprising tetracene;

a nitrate ester fuel; and strontium nitrate.

2. The primer composition of claim 1, wherein said percussion-sensitive explosive is diazodinitrophenol.

3. The primer composition of claim 1, wherein the nitrate ester fuel is a small arms propellant consisting of 60 to 90% nitrocellulose and 10 to 40% nitroglycerin.

4. The primer composition of claim 3, wherein the said propellant consists of spheres of 0.011 to 0.018 inch diameter.

5. A primer composition comprising about 20 to 30% diazodinitrophenol, 4 to 8% tetracene, 15 to 30% nitrate ester fuel and 40 to 52% strontium nitrate.

6. The primer composition of claim 5 comprising 24% diazodinitrophenol, 6% tetracene, 48% strontium nitrate and 22% nitrate ester fuel.

7. A primer composition comprising diazodinitrophenol and strontium nitrate.

8. The method of producing a strontium nitrate container primer composition which comprises hydrating anhydrous strontium nitrate to a moisture content of from 10 to 13%, and thereafter mixing it with a percussion-sensitive explosive and a nitrate ester fuel.

9. The method of claim 8, wherein said hydrating is accomplished by forming a warm, saturated, aqueous solution of anhydrous strontium nitrate, cooling said solution to below 38 degrees F. to cause precipitation of strontium nitrate tetrahydrate crystals, and thereafter heating said crystals in warm air to evaporate moisture until the total moisture thereof is between about 10 to 13%.

10. The method of forming a primer composition comprising the steps of dissolving anhydrous strontium nitrate in water at about 80 degrees F. to form a saturated solution thereof, cooling said water to between about 36 to 38 degrees F. whereby strontium nitrate tetrahydrate crystals precipitate therefrom, exposing said crystals to warm air to reduce the total moisture content thereof to between 10 and 13%, and mixing said crystals having a moisture content of between 10 and 13% with a percussion-sensitive explosive, a nitrate ester fuel, and a secondary explosive.

11. The method of claim 10, wherein said primer composition comprises 20 to 30% diazodinitrophenol, 4 to 8% tetracene, 15 to 30% nitrate ester fuel, and 40 to 52% strontium nitrate.

* * * * *